US008220953B1

(12) United States Patent
Moore

(10) Patent No.: US 8,220,953 B1
(45) Date of Patent: Jul. 17, 2012

(54) MODULAR POWER GRID ILLUMINATION SYSTEM

(75) Inventor: Harold A. Moore, West Olive, MI (US)

(73) Assignee: TSM Associates, Inc., Irvine, CA (US)

( * ) Notice: Subject to any disclaimer, the term of this patent is extended or adjusted under 35 U.S.C. 154(b) by 0 days.

(21) Appl. No.: 13/291,183

(22) Filed: Nov. 8, 2011

(51) Int. Cl.
*F21V 21/00* (2006.01)

(52) U.S. Cl. ..... 362/217.01; 362/217.14; 362/368; 362/576; 362/581

(58) Field of Classification Search ..... 362/217.01, 362/217.1, 217.14, 221, 249.02, 368, 555, 362/576, 581, 800
See application file for complete search history.

(56) References Cited

U.S. PATENT DOCUMENTS

| | | | |
|---|---|---|---|
| 4,705,255 | A | 11/1987 | Reed, Jr. |
| 4,822,292 | A | 4/1989 | Thayer et al. |
| 4,919,625 | A | 4/1990 | Coutre |
| 5,226,724 | A | 7/1993 | Kanarek |
| 5,702,176 | A | 12/1997 | Engle |
| 5,823,655 | A | 10/1998 | Brooks |
| 6,276,810 | B1 | 8/2001 | Vosshenrich |
| 6,361,186 | B1 | 3/2002 | Slayden |
| 6,371,634 | B1 | 4/2002 | Tufte |
| 6,435,693 | B1 | 8/2002 | Fiene |
| 6,536,924 | B2 | 3/2003 | Segretto |
| 6,969,179 | B2 | 11/2005 | Sloan et al. |
| 7,114,826 | B1 | 10/2006 | Lilly |
| 2002/0060526 | A1 | 5/2002 | Timmermans et al. |
| 2003/0021110 | A1 | 1/2003 | Noh |
| 2003/0102810 | A1 | 6/2003 | Cross et al. |
| 2003/0103347 | A1 * | 6/2003 | Friend ..... 362/225 |
| 2004/0012959 | A1 | 1/2004 | Robertson et al. |
| 2004/0047154 | A1 | 3/2004 | Miller et al. |
| 2004/0189218 | A1 | 9/2004 | Leong et al. |
| 2007/0183156 | A1 | 8/2007 | Shan |
| 2010/0135020 | A1 | 6/2010 | Moore |

* cited by examiner

*Primary Examiner* — Stephen F Husar
*Assistant Examiner* — Meghan Dunwiddie
(74) *Attorney, Agent, or Firm* — Warner Norcross & Judd LLP

(57) ABSTRACT

A modular power grid illumination system is provided. The illumination system generally includes a luminary including a light emitting module, a longitudinal housing assembly to receive the light emitting module, first and second end caps at opposite ends of the housing assembly, and first and second twist-in connectors coupled to respective first and second end caps. The twist-in connectors couple the luminary to a power grid at opposing ends of the luminary while also providing a source of low voltage electrical power to the luminary.

20 Claims, 4 Drawing Sheets

MODULAR POWER GRID ILLUMINATION SYSTEM

FIELD OF THE INVENTION

The present invention relates to a modular lighting system that installs easily and provides energy-efficient illumination for work areas, merchandise, atmospheric lighting, task lighting, safety lighting and the like.

BACKGROUND OF THE INVENTION

Industrial and commercial office areas, retailers and other merchandise outlets, such as supermarkets, pharmacies, department stores, convenience stores and the like, require sufficient illumination in order for the staff to perform their duties, to display merchandise, and for customers to view merchandise, as well as for vendors to deliver and sell merchandise. Naturally, lighting is important for performing office duties, making products easy to find and identify, and attractive to consumers. Fluorescent lighting fixtures have been used in such applications because the fluorescent tubes are brighter, more energy efficient and generate less heat than conventional incandescent bulbs. However, the use of fluorescent lights has many drawbacks. The thin-walled glass of fluorescent tubes is easily broken or burnt. Fluorescent tubes have relatively short operational lives and must be frequently replaced. Conventional fluorescent tubes and ballast lighting assemblies are usually quite large and difficult to arrange or re-locate where needed. Removal of the fluorescent tubes for replacement or other maintenance procedures is quite cumbersome and time consuming. For these reasons, it is customary for industrial, commercial and retailers to have maintenance contracts wherein all of the fluorescent tubes in the facilities are replaced on a scheduled basis, which is typically well before the operational lives of the fluorescent tubes expires.

In addition, fluorescent tubes are far from ideal for many other reasons. For example, fluorescent tubes are only readily available in relatively few lengths. Thin glass walls of fluorescent tubes are easily broken or shattered, as noted above, which is a safety concern. Mercury within the fluorescent tubes also presents safety concerns.

Accordingly, there remains a need for an improved illumination system which has a relatively long operational life, is easier to maintain and has reduced maintenance and energy costs in comparison with existing lighting systems. Additionally, an improved illumination system is desired which occupies less space and provides an even distribution of light to a surface or objects.

SUMMARY OF THE INVENTION

A modular power grid illumination system is provided. The illumination system generally includes an elongated luminary including a plurality of light emitting elements, opposing twist-in connectors to supportably receive the luminary therebetween, and a power grid including an elongated channel. The twist-in connectors couple the luminary to the elongated channel while also providing an electrical connection from the elongated channel to the luminary.

The luminary includes a light-transmissive housing assembly, a module and opposing end caps. The module can include an array of light emitting elements disposed in a side-by side or spaced apart relationship in one or more longitudinal rows. A first end cap is coupled to a twist-in connector to provide a supply of DC power to the module. A second end cap is coupled to the opposing twist-in connector to support the housing assembly and module therebetween.

The first and second twist-in connectors can each include a head portion shaped to interfit with the elongated channel. The head portions includes positive and negative terminals to contact spaced apart electrical connector strips within the elongated channel. The elongated channel is generally positioned over an area where illumination is desired. For example, the elongated channel can be secured to a mounting surface such as a wall, ceiling, baseboard, cabinet, or shelving surface.

The light emitting elements can include LEDs. For example, the light emitting elements can include pronged or surface mount LEDs. Other light emitting elements are also possible, optionally those which are energy efficient to operate, relatively small in size and/or radiate a negligible or insignificant amount of heat. The light emitting module can include a circuit board, for example, a printed circuit board having surface mounted LEDs located in a spaced apart, generally linear relationship.

The present system may further include other appropriate circuitry for enabling the operation of the system, for example an LED regulated step down driver coupled to a mains voltage. Advantageously, the system can install without screws, bolts or similar fasteners for securing the housing to the mounting surface. The modular power grid illumination system can therefore be highly energy efficient, easy to manufacture, assemble and use, highly versatile, modular, and suitable for use in commercial, industrial, retail and residential establishments.

These and other features and advantages of the present invention will become apparent from the following description of the invention, when viewed in accordance with the accompanying drawings and appended claims.

DETAILED DESCRIPTION OF THE CURRENT EMBODIMENT

Figure 1C:
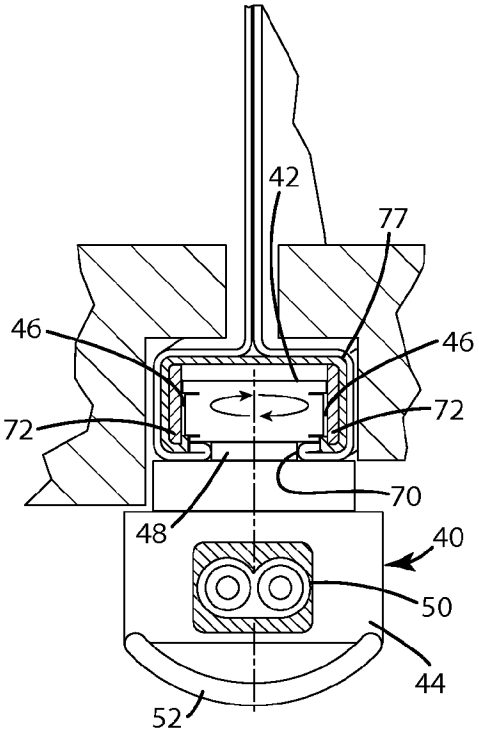
FIGS. 1A-1F are views of a modular power grid illumination system in accordance with an embodiment of the present invention.

A modular power grid illumination system is shown in FIGS. 1-6 and generally designated 10. The illumination system 10 generally includes a luminary 20, two or more twist-in connectors 40 and a power grid 60. The twist-in connectors 40 couple the luminary 20 to the power grid 60 at opposing ends of the luminary 20 while also providing an electrical connection between the power grind and the luminary 20.

Each luminary 20 includes an elongate light emitting module 28, a housing assembly 26 and opposing end caps 32 for connection to the twist-in connectors 40. The light emitting module 28 can include a printed circuit board for supporting an array (e.g. a row) of light emitting elements 30. The light emitting elements 30 can include, but are not limited to, surface mounted lights or pronged LEDs.

Figure 5:
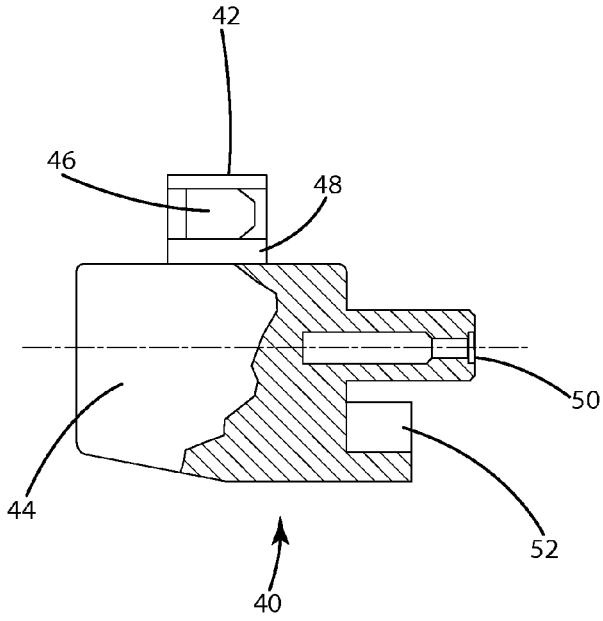
FIG. 5 is a cross sectional view of a twist-in connector.
Figure 6A:
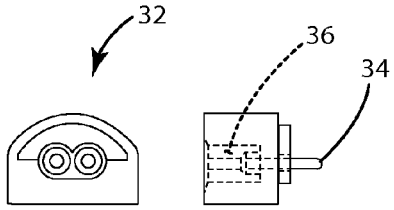
FIGS. 6A-6D are views of end caps for a luminary.
Figure 6B:
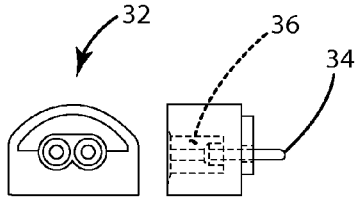
Figure 6C:
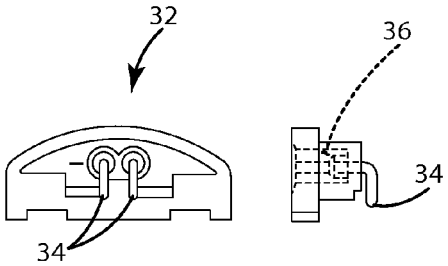
Figure 6D:
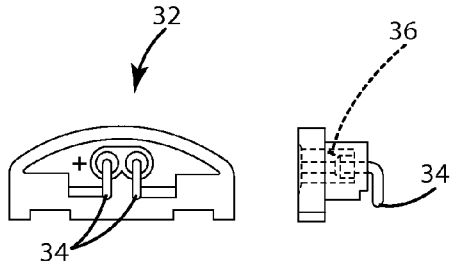

The twist-in connectors 40 includes a head portion 42 and a body portion 44. The head portion 42 extends upwardly from the body portion 44 to anchor the twist-in connector 40 to the power grid 60. The head portion 42 includes first and second electrical terminals 46 extending radially outwardly therefrom. The terminals 46 are biased radially outward from the head portion 42 as shown in FIG. 5. The head portion 42 further includes a neck 48 having a reduced width to interfit with the power grid 60 as discussed below. The body 44 includes a female receptacle 50 and a lip 52 for supporting the luminary 20. The female receptacle 50 is shaped to receive male connectors 34 from the end cap 32 as perhaps best shown in FIG. 4. In addition, the terminals 46 are electrically connected to contacts within the female receptacle 50 for the transfer of a low voltage DC current therethrough. The lip 52 is shown as arcuate, being concave to conform to the outer surface of the end cap 32. That is, the end cap 32 is sized and shaped to snugly interfit over the female receptacle 50 and under the arcuate lip 52.

The power grid 60 includes an elongate channel 62 structured to receive the twist-in connectors 40 in a slidable fashion. As shown in FIG. 1B, the channel 62 includes an upper wall 64, opposing sidewalls 66, and a lower wall 68 defining a longitudinal slot 70 therein. Flat conducting strips 72 are positioned adjacent opposing sidewalls 66 to define a space for receipt of a twist-in connector 40. An insulating sleeve 77 is interposed between the conducting strips 72 and the channel 62. Low voltage power is optionally supplied to the power grid 60 through a step down driver or transformer having an AC input (e.g. 120/277 vAC) and a DC output (e.g. 12 vDC or 24 vDC). The low voltage DC power can be distributed to the flat conducting strips 72 inside the channel 62. In the current embodiment the flat conducting strips 72 are 10 AWG, while in other embodiments the conducting strips 66 can include a different gage as desired.

During assembly, first and second twist-in connectors 40 are coupled to the power grid assembly 60 for receipt of the luminary 20 therebetween. For example, the twist-in connectors 40 are inserted into the longitudinal channel 62 and then rotated ninety degrees about an axis perpendicular to the longitudinal channel 62. Once rotated, the twist-in connector terminals 46 engage the flat conducting strips 72. The luminary 20 is then placed adjacent the channel 62 as the twist-in connectors 40 slideably engage the end caps 32. Power is then supplied from the conducting strips 72 to a twist-in connector 40 and then to the luminary 20. The opposing connector 40 lacks terminals and is instead utilized to suspend the luminary 20 from the longitudinal channel 62. The head portion 42 is dimensioned for easy insertion through the longitudinal slot 70 in a first orientation while being oversized relative to the longitudinal slot 70 in a second orientation. That is, the head portion 42 has a width greater than the width of the slot 70 so that the head portion 42 overlays the lower wall 68 in an abutting manner.

During use, the power grid 50 provides low voltage power to at least one end cap 32 (through the connector 40) which in turn provides power to the light emitting module 28 having a plurality of light emitting elements 30. The light emitting module 28 is populated with LEDs 30 and, in some embodiments, other electronic components, which when powered, project light through a clear or diffused acrylic housing assembly 26, thereby enhancing visibility of office and general lighting areas, products, areas of work stations, borders of stores, and/or creating a desired atmosphere. The luminary 20 is removed from the power grid 60 by sliding the twist-in connectors 40 away from the end caps 26 to un-plug the luminary 20 from the power grid 60. The twist-in connector 40 may be removed from the power grid 60 by, first, rotating the connector 40 approximately ninety degrees about an axis orthogonal to the longitudinal channel 62 and, second, retracting the connector head 42 from within the longitudinal channel 62.

Figure 1B:
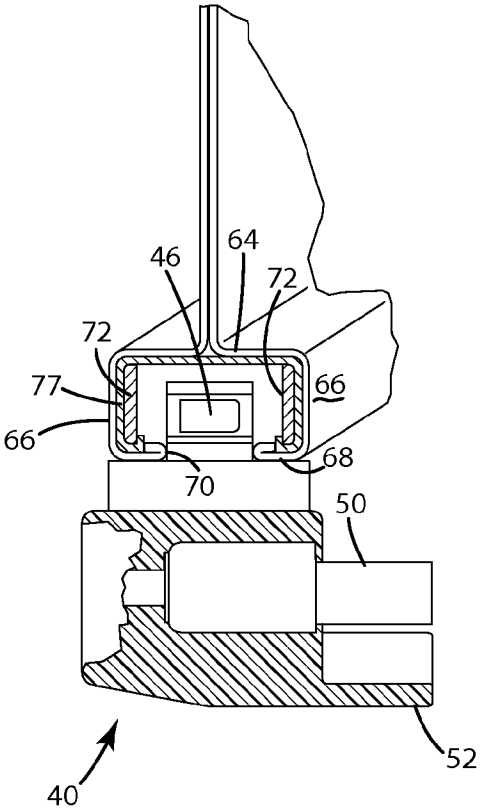
Figure 1A:
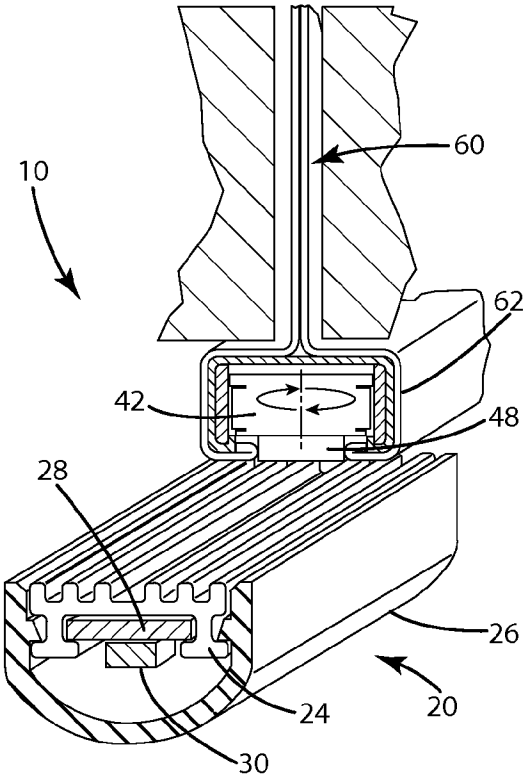
Figure 1F:
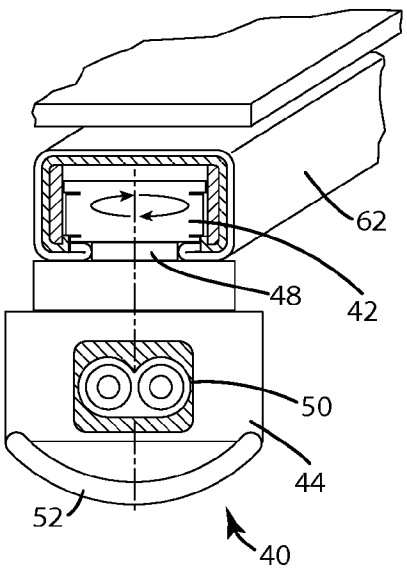
Figure 1E:
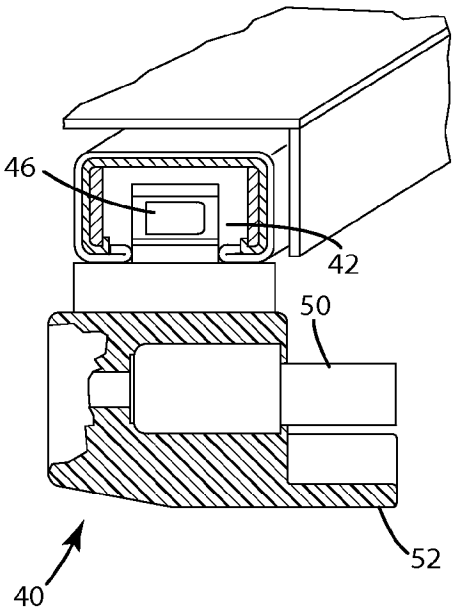
Figure 1D:
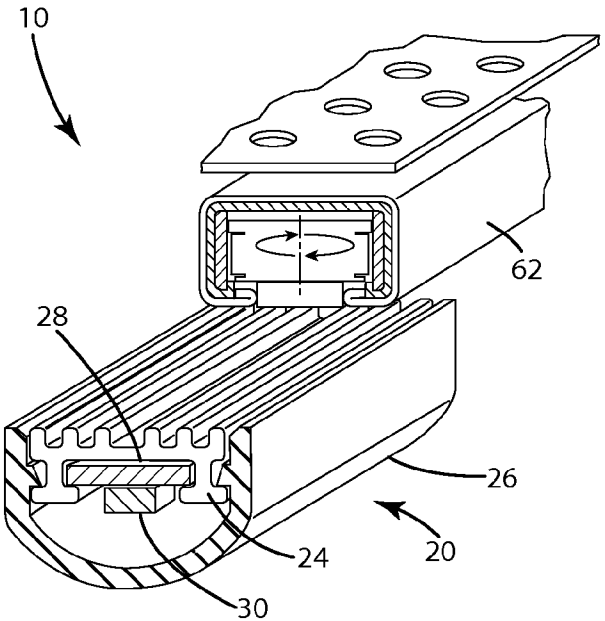
Figure 2:
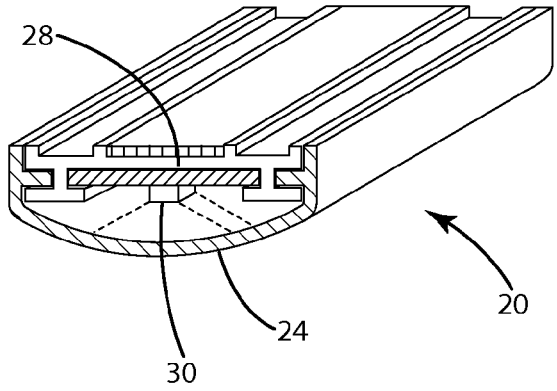
FIG. 2 is a perspective view of a luminary including a row of LEDs.
Figure 3:
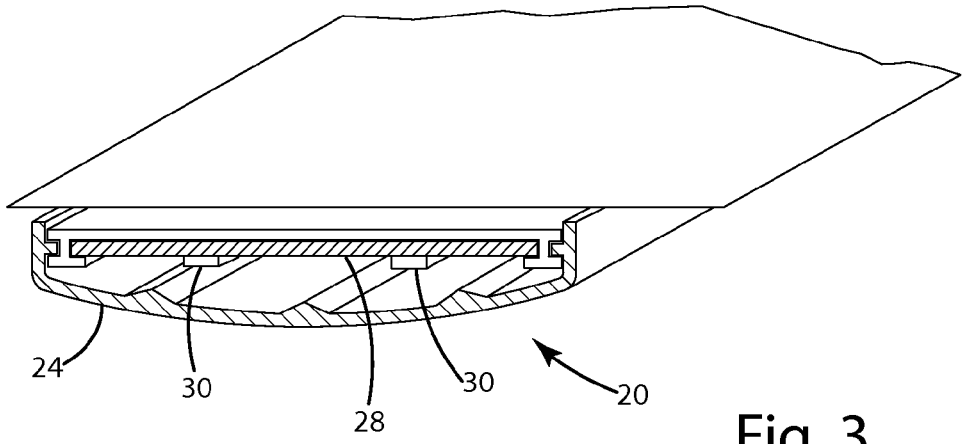
FIG. 3 is a perspective view of a luminary including two rows of LEDs.
Figure 4:
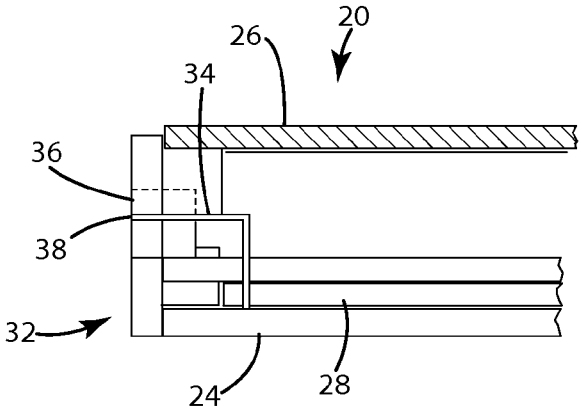
FIG. 4 is a cross-sectional view of a housing assembly and an end cap.

As shown in FIGS. 1D-1F, the modular power grid illuminated system 10 is positionable along an underside of office furniture workstations and a store fixture shelf for providing illumination to merchandise located below the workstations or shelf. The longitudinal channel 62 is optionally coupled to the supporting surface using a mechanical fastener or a double-sided adhesive. As shown in FIGS. 2-3, the luminary 20 can include one or more rows of LEDs 30 along the printed circuit board 28, optionally depending on the width of the luminary 20. In the configuration shown in FIG. 3, the printed circuit board 28, the supporting extrusion 24 and the lens 26 are widened to accommodate the additional array of LEDs 30. In addition, while only two rows are shown, the printed circuit board 28 can accommodate three or more rows of LEDs as desired.

FIGS. 4 and 6A-6D include views of various end cap assemblies 32. The end cap assembly 32 is generally secured to a terminal portion, i.e. one or both ends, of the luminary extrusion 26. The end cap assembly 32 is structured to enclose the light emitting module 28 within the luminary extrusion 26 and the supporting extrusion 24. The end cap assembly 32 is further structured and configured to facilitate electrical coupling of the luminary 20 with an appropriate power source, for example electrical power supplied through a step down LED driver or transformer as described elsewhere herein. For example, the end cap assembly 32 includes two contact pins 34 soldered or otherwise coupled to the light emitting module circuit board 28, and a socket entry cavity 36 with pin end 38 located therein. Socket entry cavity 36 is configured to receive two female sockets of a wire harness jumper, or the two female sockets 50 of a twist-in modular connector 40 (such as shown in FIG. 5 and discussed hereinafter), or other suitable connector. Rather than the pin arrangement shown in FIG. 4, the end cap assembly 32 may be differently configured, for example, the two contact pins may be replaced by two female sockets. End cap assembly 32 is secured to end surfaces of the housing 26, for example, by means of a suitable adhesive. Alternatively or additionally, end cap assembly 32 may be configured to removably or permanently snap onto the housing 32.

For purposes of example only, it is noted that the luminary 20 is suspended from a ceiling in FIGS. 1A-1C and is mounting to a bottom surface of a grocery store shelf, a work station and a wooden cabinet in FIGS. 1D-1F. Attachment to these surfaces is accomplished by means of an adhesive tape or a magnetic tape, for example. In addition, the lighting system 10 is optionally structured to enable surface mounting of an assembled luminary 20 without the need for screws, bolts or other conventional attachment devices which require puncturing or destruction of the mounting surface.

To reiterate, the system includes at least one modular power grid illumination system lighting arrangement or lighting subsystem 20 and a power grid element 60 structured to receive the twist in connector 40 and provide low voltage power to the lighting arrangement or subsystem 20, with the power grid 60 being structured to be mountable to a surface or suspended from a ceiling. The system can also include a bracket element for holding one or more of the housing and module assemblies in back-to-back arrangement, or at various angles to one another, and connectors for enabling multiple housing and module assemblies to be in electrical connection with one another. In some embodiments, the face portion comprises a first extrusion, the attachment member comprises a second extrusion, and the end caps complete the luminaries, the modular power grid illumination system being couplable together in various arrangements.

The modular power grid illumination system is particularly useful in industrial and commercial office areas, with retailers and other merchandise outlets, such as supermarkets, pharmacies, department stores, convenience stores and the like, which desire sufficient illumination in order for the staff to perform their duties, to display merchandise, and for customers to view merchandise, as well as for vendors to deliver and sell merchandise. For example, the present embodiment is useful for providing effective lighting to work areas in offices and office furniture task lighting, merchandise displayed on shelving such as produce, dairy, ice cream, dry goods, clothing, jewelry, and the like that may be displayed on gondola or other types of fixture shelving. Other commercial applications that may benefit from the present invention include merchandise retailers, hospitals and other facilities. In addition, the present modular power grid illumination system is useful in many residential applications, for example, for task lighting, lighting for shelving, architectural molding, chair railing lighting, atmosphere lighting, interior cabinet lighting, lighting for work stations and border lighting. Advantageously, the modular power grid illumination system is energy efficient, requires little maintenance, and has a long operational life, relative to conventional lighting systems used for similar purposes. Further, the modular power grid illumination system may be sized and structured to have a substantially smaller profile or depth, relative to the space requirements of conventional lighting systems, for example, those systems utilizing incandescent bulbs or fluorescent tubes.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. An illumination system, comprising:

an elongated luminary including a plurality of light emitting elements in a fixed spatial relationship and within a light-transmissive housing;

an elongated channel including first and second spaced apart conducting strips for energizing the elongated luminary; and first and second twist-in connectors slideably received within the channel to supportably receive the elongated luminary therebetween, at least one of the first and second twist-in connectors including first and second terminals extending outwardly therefrom, wherein the at least one twist-in connector provides an electrical connection between the conducting strips and the elongated luminary, wherein the elongated luminary is suspended between the first and second twist-in connectors, and wherein the elongated luminary extends parallel to the elongated channel.

2. The illumination system of claim 1 wherein the luminary includes first and second end caps, the end caps each including power input connectors recessed within a socket entry cavity.

3. The illumination system of claim 2 wherein the first and second twist-in connectors include an arcuate lip conforming to respective first and second ends caps.

4. The illumination system of claim 1 wherein the luminary includes a printed circuit board for supporting the light emitting elements thereon.

5. The illumination system of claim 1 wherein the light emitting elements include LEDs.

6. The illumination system of claim 1 wherein the elongated channel includes opposing side walls and a lower wall defining a longitudinal slot.

7. The illumination system of claim 6 wherein the first and second twist-in connectors include a head portion sized to be received within the elongate channel and a body portion extending from the head portion and interfitting with the luminary.

8. A method of illuminating an area comprising:

providing a power grid including a channel having first and second spaced apart conducting strips disposed therein;

coupling first and second twist-in connectors to the power grid channel, at least one of the first and second twist-in connectors including first and second terminals extending outwardly therefrom; and positioning an elongated luminary between the first and second twist-in connectors to provide a source of electrical power from the power grid, through the at least one twist-in connector, to the elongated luminary, wherein the elongated luminary includes a plurality of light emitting elements in fixed spatial relation within a light-transmissive housing, and wherein the elongated luminary is suspended by the first and second twist-in connectors and extends parallel to the power grid channel.

9. The method of claim 8 wherein the providing step includes positioning the power grid channel along one of a ceiling, shelf and work station troffer.

10. The method of claim 8 wherein the plurality of twist-in connectors include a head portion sized to be received within the channel and a body portion extending from the head portion and interfitting with the elongated luminary.

11. The method of claim 8 wherein the elongated luminary includes first and second end caps, a light transmissive housing and light emitting module.

12. The method of claim 11 wherein the first and second end caps include a socket entry cavity and first and second power input connectors recessed within the socket entry cavity.

13. The method of claim 12 wherein the first and second twist-in connectors include an arcuate lip conforming to respective first and second ends caps.

14. The method of claim 8 wherein the power grid channel includes opposing side walls and a lower wall defining a longitudinal slot.

15. An illumination system for a power grid including a channel having first and second spaced apart conducting strips disposed therein, the system comprising:

an elongated luminary including first and second end caps, a light transmissive housing and a light emitting module, the light emitting module including a plurality of light emitting elements in a fixed spatial relationship to project light through the light-transmissive housing; and first and second twist-in connectors slideably received within the channel to supportably receive the elongated luminary therebetween, the first and second twist-in connectors including a head portion sized to be received within the channel and a body portion extending from the head portion and interfitting with respective first and second end caps, wherein the elongated luminary is supported by the first and second twist-in connectors, and wherein the elongated luminary extends parallel to the power grid channel.

16. The illumination system of claim 15 wherein the head portion of at least one of the first and second twist-in connectors includes first and second terminals extending outwardly therefrom.

17. The illumination system of claim 15 wherein the first and second twist-in connectors include a protruding arcuate lip conforming to respective first and second ends caps to support the luminary against the power grid channel.

18. The illumination system of claim 15 wherein the light emitting module includes a printed circuit board for supporting a plurality of light emitting diodes thereon.

19. The illumination system of claim 15 wherein the luminary includes a light transmissive housing extending between the first and second end caps.

20. The illumination system of claim 15 wherein the first and second end caps include a socket entry cavity and first and second power input connectors recessed within the socket entry cavity.

* * * * *